United States Patent [19]
Suzuki

[11] 4,402,498
[45] Sep. 6, 1983

[54] COPYING MACHINE USING SHEET CASSETTE

[75] Inventor: Minoru Suzuki, Tokyo, Japan

[73] Assignee: Ricoh Company, Ltd., Tokyo, Japan

[21] Appl. No.: 245,797

[22] Filed: Mar. 20, 1981

[30] Foreign Application Priority Data

Apr. 4, 1980 [JP] Japan ..... 55-45611[U]

[51] Int. Cl.³ ..... B65H 5/00
[52] U.S. Cl. ..... 271/164
[58] Field of Search ..... 271/9, 109, 162, 164, 271/163

[56] References Cited

U.S. PATENT DOCUMENTS 4,049,256 9/1977 Church ..... 271/9
4,131,274 12/1978 Sue ..... 271/164 X
4,311,379 1/1982 Falomo ..... 271/9 X

*Primary Examiner*—Richard A. Schacher
*Attorney, Agent, or Firm*—David G. Alexander

[57] ABSTRACT

A copying machine has a body formed with first and second openings (18, 30) at independent faces (**10*b*, 10*a*) thereor for selective access of a sheet cassette (12) to a predetermined sheet feed position inside the machine body (10) therethrough in first and second predetermined directions (A, B), respectively, which are perpendicular to each other. A supporting and locating section defined at an area inside the machine body (10) where imaginary extensions of the first and second openings (18, 30) overlap each other causes the sheet cassette (12) to be seated in the sheet feed position regardless of the direction in which the sheet cassette (12) is introduced into the machine body (10). In the sheet feed position, the sheet cassette (12) is releasably retained by a locking mechanism associated with the supporting and locating section. A photoelectric sensor (52) is provided to the machine body (10) to check dislocations of the sheet cassette (12) from the sheet feed position in cooperation with a reflector piece on the sheet cassette (12**).

15 Claims, 9 Drawing Figures

COPYING MACHINE USING SHEET CASSETTE

BACKGROUND OF THE INVENTION

The present invention relates to a copying machine which feeds sheets from sheet cassettes detachably set therein and, more particularly, to an improved copying machine having first and second openings selectively usable for the access of a sheet cassette to a predetermined position thereinside.

A copying machine such as an electrophotographic copier reproduces images on a roll of sheet, cut pieces of sheet or like suitable form of sheet. A sheet cassette may be loaded with a stack of predetermined number of cut sheets having a given size or format. The body of a copier may be so designed as to allow the movement of the sheet cassette into or out of its interior through one of the opposite lateral sides thereof. This one side for the sheet cassette to have access to the machine body may be the right-hand side as viewed from the front where an operator of the machine will stand to manipulate the machine.

Apart from the fundamental copying function, modern electrophotographic copying machines have been furnished with various optional functions. For instance, such a copier may be used in combination with a sorter or a collator to carry out automatic operations for sorting or collating copy sheets coming out of the copier. The sorter or the collator in use is physically connected with a specific side of the copier where copy sheets will be discharged from the copier.

A known type of copying machine has a cassette insertion opening or mouth and a sheet discharge tray positioned one above the other at one side of the machine. When combined with this type of machine, a sorter or a collator will adjoin said specific side of the machine body to take over copy sheets discharged from the copier. Thus, an operator needs to perform a troublesome work for moving the sorter or the collator away from the copier whenever he or she intends to mount or demount the sheet cassette into or out of the cassette insersion opening or mouth of the copier.

Copying machines are often installed in relatively narrow areas in offices and other buildings and, in this respect, they should preferably occupy as small spaces as possible. In fact, however, a copier of the type described requires a certain additional space therearound to accommodate the ingress or egress of the sheet cassette which eventually increases the overall space occupied by the copier. Where for example the copier is located at a corner of a room defined by two walls, the side of the copier having the mouth must not stand near to the walls.

Thus, if the sheet cassette can have access to the interior of the copying machine not only at the cassette side concerned but at the front where the machine will be manipulated by an operator, it will become possible to save the time and labor necessary for moving a sorter or a collator even at the time of replacement or the like of a sheet cassette or to install the machine body in a desired space with the cassette side adjacent to a wall.

SUMMARY OF THE INVENTION

A copying machine embodying the present invention includes a body having a first opening or mouth at one face thereof to permit ingress or egress of a sheet cassette therethrough into or out of the body in a first predetermined direction, and a second opening or mouth at another face to permit ingress or egress of the sheet cassette therethrough in a second predetermined direction perpendicular to said first direction.

In accordance with the present invention, a copying machine has a body formed with first and second openings at independent faces thereof for selective access of a sheet cassette to a predetermined sheet feed position inside the body therethrough in first and second predetermined directions, respectively, which are perpendicular to each other. A supporting section defined at an area inside the machine body where imaginary extensions of the first and second openings overlap each other causes the sheet cassette to be seated in the common sheet feed position regardless of the direction in which the sheet cassette is introduced into the machine body. In the sheet feed position, the sheet cassette is releasably retained by a locking mechanism associated with the supporting section. A photoelectric sensor is provided to the machine body to check dislocations of the sheet cassette from the sheet feed position in cooperation with a reflector piece carried on the sheet cassette.

It is an object of the present invention to make as small as possible a space occupied by a copying machine of the type using a sheet cassette.

It is another object of the present invention to ensure a wide range of locations available for the installation of the copying machine.

It is another object of the present invention to eliminate the need to form a space for accommodating ingress or egress of the sheet cassette into or out of the machine by manually moving a collator or a sorter which may be used in combination with the copying machine.

It is another object of the present invention to lock the sheet cassette in a predetermined sheet feed position inside the copying machine where it will have a proper cooperative relation with a sheet feed mechanism of the copying machine.

It is another object of the present invention to sense dislocations of the sheet cassette from the sheet feed position to thereby promote accurate feed of sheets from the sheet cassette.

It is another object of the present invention to provide a generally improved copying machine.

Other objects, together with the foregoing, are attained in the embodiment described in the following description and illustrated in the accompanying drawings.

DESCRIPTION OF THE PREFERRED EMBODIMENT

While the copying machine of the present invention is susceptible of numerous physical embodiments, depending upon the environment and requirements of use, substantial numbers of the herein shown and described embodiment have been made, tested and used, and all have performed in an eminently satisfactory manner.

Figure 1:
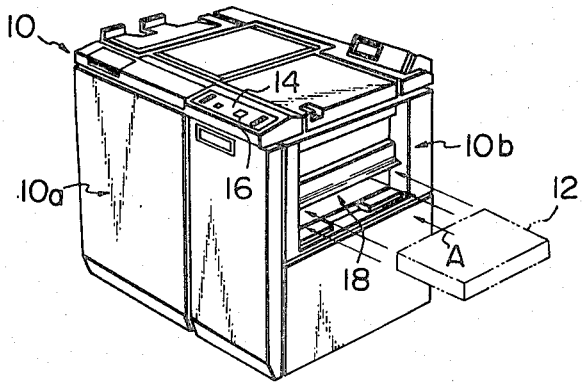
FIG. 1 is a perspective view of a copying machine according to the present invention which uses a sheet cassette.

Referring to FIG. 1 of the drawings, a copying machine generally comprises a body 10 and a sheet cassette 12 freely movable into and out of the body 10 with sheets of a selected size stacked thereon as will be described. The machine body 10 has as usual a control panel 14 which carries thereon various members for manipulation such as a print button 16 as well as various displays as the case may be. Of the four sides of the body 10, one adjacent to the control panel 14 and which therefore an operator of the machine will customarily stand adjacent to will be referred to as the "front" face of the machine and denoted by 10*a*. Another side of the machine, the right-hand side for example, will be called a "side" face and denoted by 10*b*. The machine body 10 has an elongate opening or mouth 18 at the side face 10*b* which permits the sheet cassette 12 to enter or leave the machine body 10 therethrough in a direction A parallel to a predetermined sheet feed direction which will be defined hereinafter.

Figure 2:
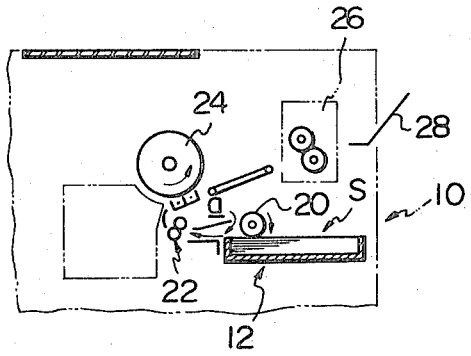
FIG. 2 is a schematic view of an internal arrangement of the copying machine with the sheet cassette mounted therein.

As shown in FIG. 2, the machine body 10 houses therein a sheet feed mechanism and other various mechanism coactive to produce copy sheets. The sheet feed mechanism is represented by multiple rollers 20 (only one is visible) which are rotatable on a common shaft as indicated by an arrow to feed sheets S one by one from the stack on the sheet cassette 12 in a determined sheet feed direction a. It should be noted that the sheet feed direction a is a specific direction in which each sheet S is fed from the cassette 12 toward a registration roller pair 22 which in turn will drive the sheet S further therefrom after a predetermined pause to a photosensitive drum 24.

A sheet S fed from the cassette 12 by the rollers 20 is stopped a moment at the registration roller pair 22 and then advanced thereby at a determined timing toward the drum 24 which rotates as indicated by an arrow. At a preselected station around the drum 24, a toner image carried on the surface of the drum 24 is transferred onto the sheet S. The sheet now carrying the toner image further advances through a fixing unit 26 until it is moved out of the machine onto a tray 28. This outlined part of a copying cycle is known per se and will not be discussed any further.

Figure 3:
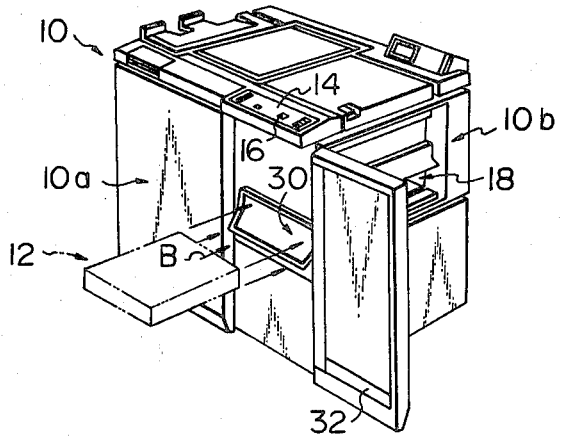
FIG. 3 is a view similar to FIG. 1 but showing a second opening or mouth of the machine for sheet cassette insertion which may be covered by a door when out of use.

One of characteristic features of the present invention resides in the provision of a second opening or mouth 30 formed at the front face 10*a* of the machine body 10 as illustrated in FIG. 3. The second mouth 30 like the first mouth 18 allows ingress or egress of the sheet cassette 12 therethrough but in a direction B perpendicular to the direction A and, therefore, to the sheet feed direction a (FIG. 2). The reference numeral 32 in FIG. 3 designates a door which is hinged to the machine body 10 and openable to the illustrated position so as to make operator's access to the second mouth 30 possible when this mouth 30 is selected. As will be noted, however, the door 32 does not form any essential part of the present invention and it may therefore be omitted.

Figure 4:
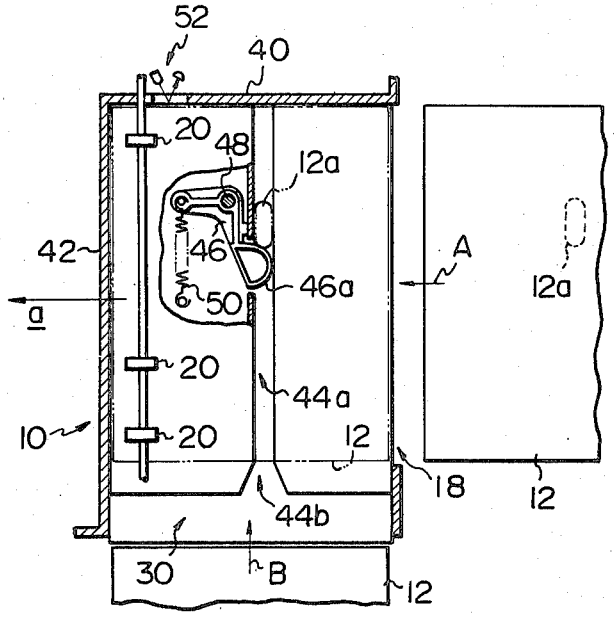
FIG. 4 is a horizontal section of an arrangement inside the machine adapted to support and lock the sheet cassette in a predetermined sheet feed position.

Referring to FIG. 4, the machine body 10 has thereinside a cassette supporting and locating section which is defined in an area where imaginary extensions of the first and second mouths 18 and 30 overlap each other. The supporting and locating section according to the present invention is formed by two interconnected vertical walls 40 and 42 and one horizontal wall 44 (see FIG. 5) which is connected with the vertical walls 40 and 42. The sheet cassette 12 will be inserted into the machine body 10 through the mouth 18 or 30 in the direction A or B as desired until it settles at a predetermined sheet feed position within the supporting and locating section. Indicated by a phantom line in the drawing, the sheet feed position should be taken to mean a position where the sheet cassette 12 allows the sheet feed rollers 20 to properly function in moving a sheet atop the stack in the sheet feed direction a. The sheet cassette 12 has a downwardly extending lug 12*a* at its bottom whereas the horizontal wall 44 of the machine body 10 has a guide channel or recess 44*a* extending perpendicular to the direction A or parallel to the direction B. When the operator intends to mount the sheet cassette 12 into the machine body 10 through the second mouth 30 in the direction B perpendicular to the sheet feed direction a, he or she will push it into the mouth 30 keeping a wall of the cassette 12 in contact with the wall 42 of the machine and piloting the lug 12*a* into the recess 44*a*.

Figure 8:
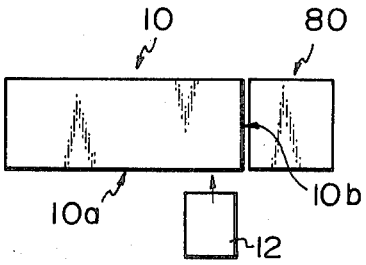
FIG. 8 shows in plan a layout of the copying machine and a coactive sorter or a collator and a manner of sheet cassette insertion applicable to this case.
Figure 9:
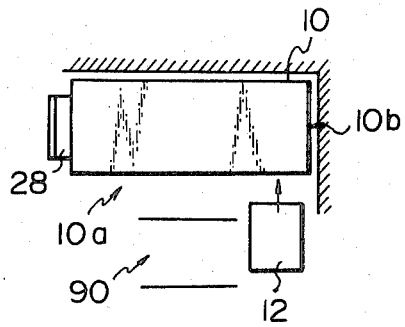
FIG. 9 is a plan view of the copying machine located at a corner adjacent to walls and a manner of sheet cassette insertion employed.

With the construction and arrangement described above, the sheet cassette 12 can be moved into or out of the machine body 10 either at the front face 10*a* or at the side face 10*b* of the machine body 10. This dual mouth system facilitates the ease of operation of a copying machine and enlarges the range of available locations for its installation. Where the copier is used in combination with a sorter or a collator 80 as shown in FIG. 8, the operator needs only to attach or detach the sheet cassette 12 at the front face 10*a* of the machine body 10 without the conventional troublesome removal of the sorter or the collator 80. A layout indicated in FIG. 9 is also available in which the copier is positioned with its side face 10*b* spaced little from a wall. This layout will prove particularly useful for a copier of the type having a discharge tray 28 in the illustrated position. It will be seen that the FIG. 9 layout will ensure safe mounting and demounting of the sheet cassette 12 if the door 32 (FIGS. 1 and 3) is omitted. It will be noted in FIG. 9 that a passage 90 may be utilized for the ingress or egress of the sheet cassette 12 if such a passage is present in the illustrated position.

Turning back to FIGS. 4–6, there is shown a very simple form of locking mechanism which is applicable to the present invention for retaining the sheet cassette 12 when the latter is placed in the sheet feed position inside the machine body 10. A unique design here consists in permitting a single locking mechanism to latch the sheet cassette 12 in the sheet feed position regardless of the direction A or B of cassette insertion.

Figure 5:
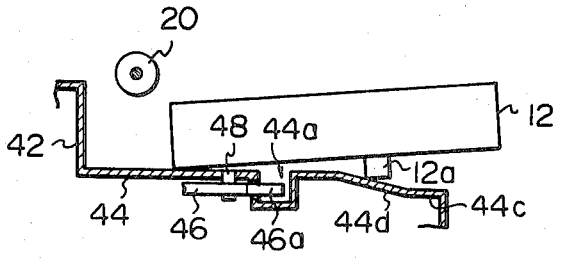
FIG. 5 is a vertical section of the arrangement shown in FIG. 4 indicating the sheet cassette advanced halfway in one direction toward the sheet feed position.
Figure 6:
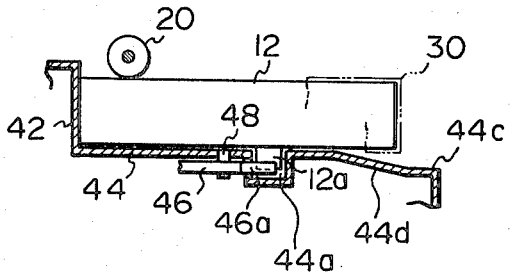
FIG. 6 shows the sheet cassette seated in the sheet feed position also in vertical section.

The locking mechanism includes an angled lever 46 which is movable about a stud 48 secured to the horizontal plate 44 of the machine body 10. The lever 46 has one end which terminates at a locally rounded stop portion 46*a*. The other end of the lever 46 is constantly biased by a tension spring 50 such that the lever 46 tends to rotate counterclockwise in the drawing to have the rounded surface of the stop portion 46*a* positioned in the guide channel 44*a* through a slot (no numeral) formed through one wall of the channel. A shot lug (no numeral) on the lever 46 limits the counterclockwise movement of the lever 46 by abutting against the wall of the channel 44*a*. As viewed in FIG. 4, the channel 44*a* is provided at one end with a guide portion 44*b* which diverges toward the second mouth 30. It should be recalled here that the lug 12*a* protrudes downward from the bottom of the sheet cassette 12 as best shown in FIG. 5.

When the operator intends to attach the sheet cassette 12 in the direction A through the mouth 18, he or she places the lug 12*a* on the cassette 12 on a flat part 44*c* (FIG. 5) of the plate 44 adjacent to the inlet while causing a part of the sheet cassette 12 to abut against the vertical wall 40 which serves as a reference surface. As the sheet cassette 12 thus positioned is pushed deeper into the machine, the lug 12*a* slides along the flat part 44*c* over to an inclined part 44*d* (FIG. 5) of the plate 44 and then drops into the channel 44*a* as viewed in FIG. 6. In the channel 44*a*, the stop portion 46*a* on the lever 46 presses the lug 12*a* and thereby retains the sheet cassette 12 in the sheet feed position. To remove the sheet cassette 12 from the machine, the operator will raises its part adjacent to the mouth 18 to move the lug 12*a* out of the channel 44*a* and then pull the sheet cassette bodily out of the machine in the opposite direction to the direction A.

When the sheet cassette 12 is inserted into the second mouth 30 and pushed in the direction B into the machine, it advances with its lug 12*a* piloted by the contiguous guide 44*b* and channel 44*a*. It will be seen that the guide 44*b* serves to promote smooth engagement of the lug 12*a* in the channel 44*a*. As the lug 12*a* abuts against the stop portion 46*a* on the lever 46, it causes the lever 46 to swing clockwise about the stud 48 in FIG. 4 against the action of the spring 50. After the movement of the lug 12*a* past the stop portion 46*a*, the spring 50 urges the lever 46 counterclockwise back to the normal position shown in FIG. 4 so that the stop portion 46*a* presses the lug 12*a* to lock the sheet cassette 12 in place. For the removal of the sheet cassette 12 from the machine, it suffices to simply pull the sheet cassette 12 out of the machine body 10 in the opposite directon to the directon B. During this rearward movement, the lug 12*a* will depress the stop portion 46*a* to move the lever 46 clockwise about the stud 48 against the action of the spring 50. As the lug 12*a* moves clear of the stop portion 46*a*, the lever 46 will regain the normal position shown in FIG. 4.

The copying machine also includes means for sensing incomplete setting of the sheet cassette 12 in the machine body 10 though this is an optional item. As shown in FIG. 4, this means may take the form of a photoelectric sensor 52 made up of a light emitting element and photodetective element and mounted to a part of the vertical wall 40 of the machine body 10. The photosensor will have a cooperative relation with a piece (not shown) carrying a white pattern thereon and adhered as reflector means to a side wall of the sheet cassette.

When the sheet cassette 12 is placed properly in a predetermined position, light from the light emitting element of the sensor 52 will be reflected by the reflector on the sheet cassette 12 to the photodetector so that an electric signal will be produced indicating the complete setting of the sheet cassette. When the sheet cassette 12 is out of the predetermined position, no light will be incident on the photodetector and the failure will be displayed on the control panel. More specifically, in this embodiment, the sensor 52 and white reflector are prevented from cooperating with each other when the lug 12*a* on the cassette 12 is not accurately positioned by the channel 44*a* and lever 46 in the sheet feed position. The result is the delivery of a signal indicative of the positioning failure and causing the failure to be displayed on the control panel for instance.

Figure 7:
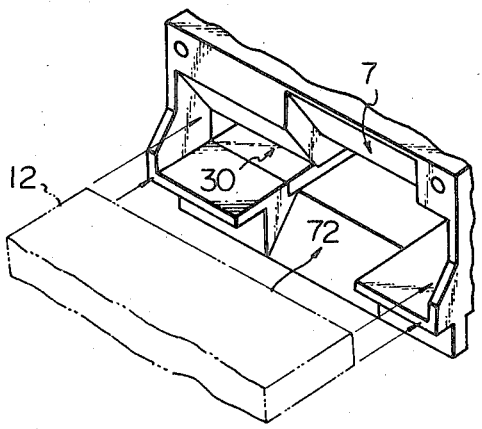
FIG. 7 shows a modified form of the second mouth.

If desired, parts of the front side 10*a* defining the upper and lower edges of the mouth 30 may be shaped to make the mouth 30 tapered inward in the direction B as indicated by reference numerals 70 and 72 in FIG. 7. Such a tapered design of the mouth will help an operator insert the sheet cassette 12 deep into the machine by accommodating the operator's hands holding the rear end of the sheet cassette.

In summary, it will be seen that the present invention provides an improved copying machine which permits a wide variety of layouts in locations for use by allowing the ingress and egress of a sheet cassette through one side of the machine body and another side different from said side selectively. When used with a sorter or the like, the machine still permits such movements of the sheet cassette without any troublesome removal of the sorter away therefrom.

Various modifications will become possible for those skilled in the art after receiving the teachings of the present disclosure without departing from the scope thereof.

What is claimed is:

1. A copying machine comprising a body having a first opening at a first face thereof to permit ingress and egress of a sheet cassette therethrough into and out of said body in a first predetermined direction, and a second opening at a second face to permit ingress and egress of the sheet cassette therethrough in a second predetermined direction which is perpendicular to said first predetermined direction;

means for supporting and locating the sheet cassette in a predetermined sheet feed position when the sheet cassette is introduced into the body through one of the first and second openings; and means for feeding sheets one by one from the sheet cassette in the first predetermined direction when the sheet cassette loaded with a sheet stack is located in the predetermined sheet feed position, said sheet feed means being positioned above the supporting and locating means inside the body.

2. A copying machine as claimed in claim 1, in which said predetermined sheet feed position is within an area inside the body where imaginary extensions of the first and second openings overlap each other.

3. A copying machine as claimed in claim 1, in which the sheet feeding means comprises a plurality of rollers arranged on a common shaft and rotatable to advance sheets in the first predetermined direction from the sheet cassette held in the sheet feed position.

4. A copying machine as claimed in claim 1, in which the supporting and locating means comprises two vertical walls interconnected perpendicular to each other and one horizontal wall connected with said vertical walls.

5. A copying machine as claimed in claim 4, further comprising locking means for retaining the sheet cassette in the sheet feed position when the sheet cassette is introduced into the body through one of the first and second openings.

6. A copying machine as claimed in claim 1, further comprising sensor means for sensing locations of the sheet cassette in the sheet feed position inside the body.

7. A copying machine as claimed in claim 6, in which the sensor means comprises a photoelectric sensor consisting of a light emitting element and a photodetector element mounted to the body to have a cooperative relation with a reflector means carried on the sheet cassette when the sheet cassette is in the sheet feed position.

8. A copying machine as claimed in claim 7, in which the reflector means on the sheet cassette comprises a piece having a white pattern thereon.

9. A copying machine as claimed in claim 1, in which parts of the second face of the body defining upper and lower edges of the second opening are shaped to make the second opening tapered inward in the second predetermined direction.

10. A copying machine as claimed in claim 1, further comprising a door hinged to the body to cover the second opening when the second opening is out of use.

11. A copying machine as claimed in claim 1, in which the first face of the body is a flank or side face and the second face is a front face which an operator of the machine will stand adjacent to for operating the machine.

12. A copying machine comprising a body having a first opening at a first face thereof to permit ingress and egress of a sheet cassette therethrough into and out of said body in a first predetermined direction, and a second opening at a second face to permit ingress and egress of the sheet cassette therethrough in a second predetermined direction which is perpendicular to said first predetermined direction;

means for supporting and locating the sheet cassette in a predetermined sheet feed position when the sheet cassette is introduced into the body through one of the first and second openings;

the supporting and locating means comprising two vertical walls interconnected perpendicular to each other and one horizontal wall connected with said vertical walls; and locking means for retaining the sheet cassette in the sheet feed position when the sheet cassette is introduced into the body through one of the first and second openings;

the locking means comprising an elongate channel extending perpendicular to the first predetermined direction and parallel to the second predetermined direction on the horizontal wall of the body, a member swingable about a stud rigid on the horizontal wall and having a stop portion at one end thereof, biasing means yieldably urging said swingable member in predetermined one direction about the stud to made the stop portion protrude into the channel on the horizontal wall through a slot formed in a wall of the channel, and means for limiting the movement of the swingable member in said one direction, whereby when the sheet cassette is inserted in the first predetermined direction through the first opening, a lug on the underside of the sheet cassette is caused to drop into the channel and retained by the biased stop portion while, when the sheet cassette is inserted in the second predetermined direction through the second opening, the lug is caused to move in and along the channel to be retained by the biased stop portion.

13. A copying machine as claimed in claim 12, in which the swingable member comprises an angled lever attached to the stud at an intermediate portion thereof and having the stop portion at the free end of its two arms, the biasing means comprising a tension spring anchored at one end to the free end of the other arm of the lever and biasing the lever about the stud in the predetermined one direction.

14. A copying machine as claimed in claim 12, in which the limiting means comprises a projection on the swingable member and a part of the wall of the channel abutted against by the projection.

15. A copying machine as claimed in claim 12, in which the channel terminates at a guide portion which diverges toward the second opening to pilot the lug on the sheet cassette into the channel when the sheet cassette is inserted into the body through the second opening.

* * * * *